US006227384B1

(12) United States Patent
Saylor et al.

(10) Patent No.: US 6,227,384 B1
(45) Date of Patent: May 8, 2001

(54) SLOTTED DIVIDER ARRANGEMENT

(75) Inventors: Charles Saylor, Grand Rapids, MI (US); Sheldon Phillips, Thousand Oaks; Edward Mitchell, Los Angeles, both of CA (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/304,161

(22) Filed: Apr. 30, 1999

(51) Int. Cl.[7] ..... B42F 17/00

(52) U.S. Cl. ..... 211/50; 211/94.01; 211/11

(58) Field of Search ..... 211/50, 94.01, 211/10, 11, 126.13, 184; 108/108, 154–156, 180, 182, 186; 312/196, 194, 245, 247, 195, 140–140.4; 248/298.1, 225.11–225.12, 223.41, 224.51, 224.61

(56) References Cited

U.S. PATENT DOCUMENTS

| | | | | |
|---|---|---|---|---|
| D. 333,489 | | 2/1993 | Stern et al. . | |
| 401,553 | | 4/1889 | Godfrey . | |
| 1,039,554 | | 9/1912 | Lindhorst . | |
| 1,106,265 | * | 8/1914 | Whittle | 211/11 |
| 1,736,574 | * | 11/1929 | Binks | 211/11 |
| 2,490,269 | * | 12/1949 | Johnson | 211/50 |
| 2,551,157 | | 5/1951 | Price . | |
| 2,658,628 | * | 11/1953 | Hilgen | 211/184 |
| 2,751,088 | * | 6/1956 | Hargett | 211/11 |
| 2,759,454 | * | 8/1956 | Swart | 211/50 |
| 2,873,860 | * | 2/1959 | Holloway | 211/50 |
| 2,884,139 | * | 4/1959 | Dunham | 211/184 |
| 2,902,166 | * | 9/1959 | Bahr | 211/184 |
| 3,812,975 | * | 5/1974 | Gutierrez | 211/11 |
| 3,955,788 | * | 5/1976 | Delage | 248/298.1 |
| 4,074,810 | * | 2/1978 | Juergens et al. | 211/11 |
| 4,126,230 | | 11/1978 | Tyson et al. . | |
| 4,160,570 | * | 7/1979 | Bridges | 312/245 |
| 4,163,497 | * | 8/1979 | McEwen | 211/11 |
| 4,209,098 | * | 6/1980 | Adams | 248/298.1 |
| 4,317,416 | | 3/1982 | Baum et al. . | |
| 4,323,291 | | 4/1982 | Ball . | |
| 4,709,891 | | 12/1987 | Barnett . | |
| 4,762,072 | * | 8/1988 | Boundy et al. | 312/196 |
| 4,796,761 | * | 1/1989 | Hermelin | 211/11 |
| 4,852,500 | | 8/1989 | Ryburg et al. . | |
| 4,879,955 | | 11/1989 | Moll et al. . | |
| 4,884,513 | | 12/1989 | Newhouse et al. . | |
| 4,905,847 | * | 3/1990 | Hanson | 211/184 |
| 4,938,442 | | 7/1990 | Mastrodicasa . | |
| 4,944,412 | * | 7/1990 | Daigre | 211/11 |
| 4,948,205 | | 8/1990 | Kelley . | |
| 4,974,913 | | 12/1990 | Vogt et al. . | |
| 4,993,785 | | 2/1991 | Dunand . | |
| 5,048,698 | | 9/1991 | Konrad . | |
| 5,057,039 | | 10/1991 | Persing et al. . | |
| 5,092,253 | * | 3/1992 | Grund et al. | 312/247 |
| 5,103,741 | | 4/1992 | Grund et al. . | |
| 5,121,698 | | 6/1992 | Kelley . | |
| 5,429,252 | | 7/1995 | Liu . | |
| 5,486,042 | | 1/1996 | Heisler et al. . | |
| 5,955,170 | * | 9/1999 | Davis et al. | 211/50 |

* cited by examiner

*Primary Examiner*—Daniel P. Stodola
*Assistant Examiner*—Jennifer E. Novosad
(74) *Attorney, Agent, or Firm*—Flynn, Thiel, Boutell & Tanis, P.C.

(57) ABSTRACT

A divider arrangement for organizing documents including a base part for supportive engagement with either an elongate mounting rail positioned above a worksurface or with a generally horizontal support surface, and a plurality of divider elements which project upwardly from the base part. Each of the divider elements is defined by an upwardly opening channel member having spaced-apart front and rear walls joined together by a bottom wall extending transversely therebetween, with a plurality of the channel members being supported on the base part in sidewardly adjacent relationship so as to define a plurality of adjacent storage slots. Each of the channel members assume a slightly angled relationship relative to the base part so that the bottom wall extends at a slight angle relative to the horizontal and the front and rear walls extend at a slight angle relative to the vertical.

13 Claims, 4 Drawing Sheets

SLOTTED DIVIDER ARRANGEMENT

FIELD OF THE INVENTION

This invention relates to an improved slotted divider arrangement for use in an office environment for storage and organization of documents, and particularly to a slotted divider arrangement for mounting on a support rail which can be disposed in raised relation relative to a worksurface to permit more efficient utilization of accessible space adjacent a worksurface.

BACKGROUND OF THE INVENTION

The modern office environment has ever increasing demands with respect to not only the availability of effective work space, particularly in association with a worksurface, but also the efficient utilization of available space around a worksurface. The demands and space requirements for computers and telecommunication equipment, as well as the demands for various office tools or accessories which are typically supported on top of a worksurface, generally results in excessive clutter on the worksurface and typically results in only minimal available work space. In an effort to increase the available work space, attempts have been made to position many of the accessories or tools on adjacent supporting elements, such as by mounting the accessories on an adjacent wall, although not only does this complicate the overall wall structure, but this alternative is not available in those situations where the worksurface is not disposed adjacent a wall. As a further alternative, some worksurfaces or table tops are provided with upright structures secured along the rear edge of the worksurface and projecting upwardly so as to provide additional storage compartments and the like, although even this alternative greatly increases the overall complexity of the worksurface arrangement and in particular significantly interferes with openness and visibility around the worksurface, thereby severely interfering with either aesthetics or team working functions. Constructions of this latter type also typically have little flexibility or adjustability.

Accordingly, it is an object of this invention to provide an improved office accessory which can be used in conjunction with a worksurface while providing significant flexibility with respect to its use as well as its location, which can be readily positionally adjusted or disassembled when usage is not desired, and which can be associated with a worksurface in a raised position or relationship so as to not interfere with the available space on the worksurface while at the same time providing minimal obstruction with respect to visibility and openness.

SUMMARY OF THE INVENTION

The improved office accessory of this invention is particularly desirable for use with and support on an elongate support rail which is positioned so as to extend along an edge of a worksurface in raised relation therewith, which support rail can be easily attached to and supported from the worksurface, or alternately can be attached to and supported from an adjacent wall. The support rail in turn permits many different types of accessories or tools to be readily attached or detached therefrom, and according to the present invention permits an improved slotted divider arrangement to be removably attached to and supported on the support rail so as to permit organized storage of selected documents or objects.

According to the present invention, in a preferred embodiment, an elongate support rail is supported so as to extend generally along and in raised relation relative to a rear edge of the worksurface. The rail is preferably supported on the worksurface by one or more intermediate support arms or stanchions, but alternately can be supported from an adjacent wall. The rail defines therein an elongate slot which extends lengthwise of the rail and, in the preferred embodiment, opens forwardly of the rail. The slotted divider arrangement is adapted to be engaged and supported on top of the rail. The divider includes a substantially horizontally planar base tray which sits on top of the rail so as to project outwardly from both sides thereof, and the base tray has a resilient flange projecting therefrom which is insertable into the slot so as to stably position the base tray on the rail. One or more generally U-shape divider elements are removably mounted on the base tray in adjacent side-by-side relation so as to define a plurality of adjacent storage slots which open transversely relative to the lengthwise direction of the support rail and are thus readily accessible by a worker standing or seated adjacent the front of the worksurface. The divider element has generally parallel but spaced front and back walls joined by a bottom wall extending generally perpendicularly therebetween. A bottom support leg or flange projects downwardly from the front edge of the bottom wall, substantially coplanar with the front wall, through a limited extent so that the lower free edge of the support flange bears against the upper surface of the base tray. This bearing engagement, in conjunction with a further bearing engagement which occurs between the base tray and the apex between the back and bottom walls, stably supports the divider element such that the front and back walls project upwardly at a small angle relative to the vertical, thereby resulting in the bottom wall of the divider element extending at a small slope or incline relative to the horizontal. The divider element and base wall preferably have a cooperating structure to assist in securing the base tray and divider elements together, which cooperating structure in the preferred embodiment includes a pair of downwardly projecting hooks associated with the front flange and aligned with and projecting downwardly through small slots formed in the base tray. The base tray can be utilized without divider elements thereon, or can have from one up to a plurality (for example, four) of divider elements mounted thereon in adjacent relationship. The divider elements can be horizontally rotated 180° relative to the base tray so as to be positioned thereon for either rightward or leftward incline.

The desirable constructional and functional features of the present invention, as well as other structural and operational advantages thereof, will be apparent upon reading the following specification and inspecting the accompanying drawings.

Figure 1:
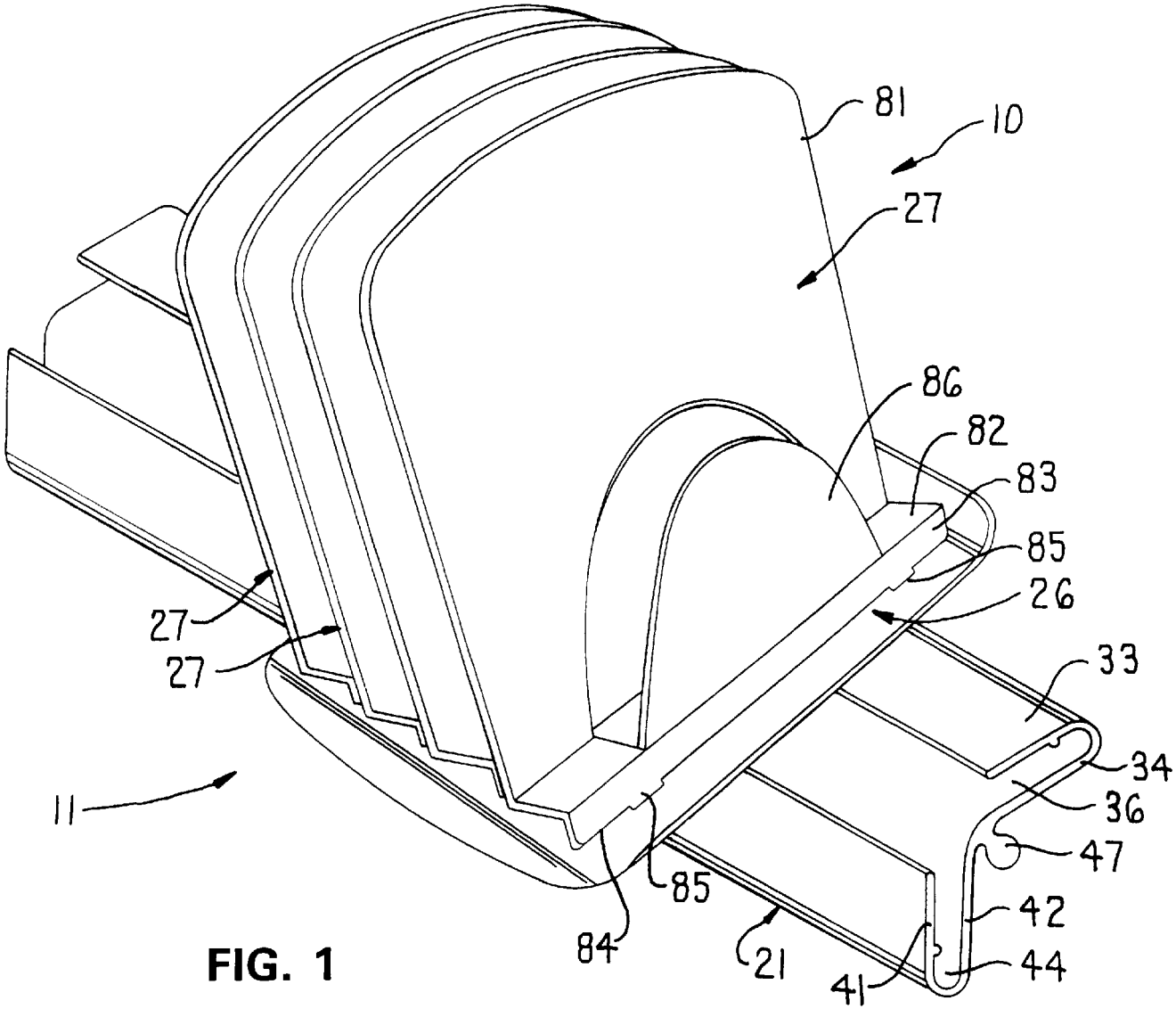
FIG. 1 is a perspective view which illustrates a slotted divider arrangement mounted on a support rail which is adapted to be positioned in working relationship with a worksurface.

Certain terminology will be used in the following description for convenience in reference only, and will not be limiting. For example, the words "upwardly", "downwardly", "rightwardly", and "leftwardly", will refer to directions in the drawings to which reference is made. The word "front" will have reference to the side of the arrangement or worksurface which is typically closest to the worker, and the word "rear" will refer to the side which is remote from the worker. The words "inwardly" and "outwardly" will refer to directions toward and away from, respectively, the geometric center of the general arrangement or of specific parts thereof. Said terminology will include the words specifically mentioned, derivatives thereof, and words of similar import.

DETAILED DESCRIPTION

Referring to the drawings, there is illustrated a slotted divider arrangement 10 according to the present invention. This arrangement 10 in the illustrated and preferred embodiment mounts on a support rail arrangement 11 which is positioned in close association with a worksurface 12.

Figure 3:
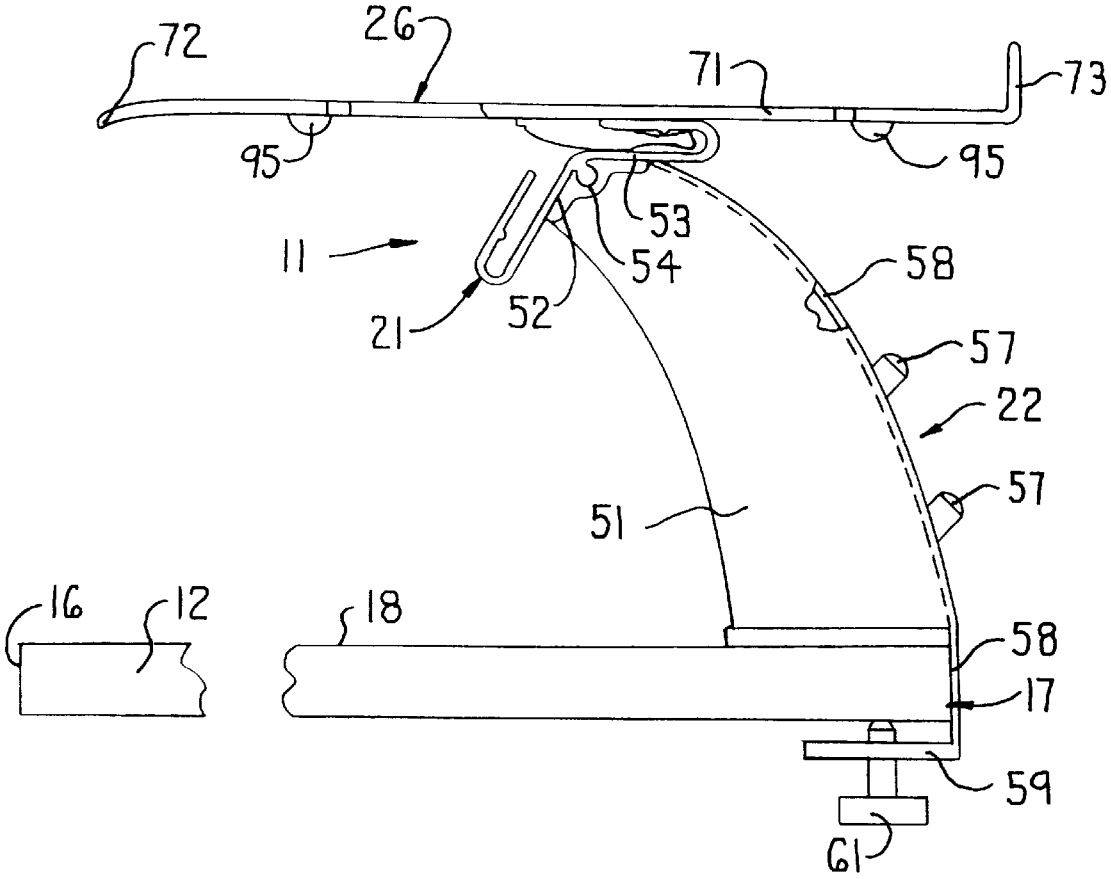
FIG. 3 is an end elevational view illustrating the attachment of the support rail to a support stanchion, the latter being mounted on a worksurface.
Figure 4:
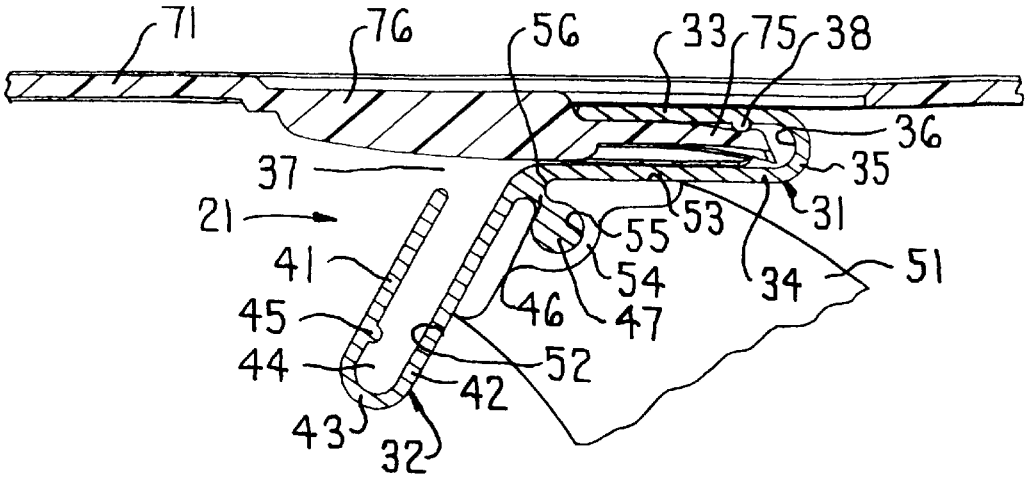
FIG. 4 is an enlarged fragmentary sectional view which illustrates the engagement between the base tray and the support rail.

The worksurface 12, as diagrammatically illustrated in FIG. 3, has respective front and rear longitudinally extending edges 16 and 17, and defines thereon an enlarged and substantially horizontal upper surface 18. The worksurface 12 can be provided with legs (not shown) so as to function as the top of a table, or can be mounted on support arms which project outwardly from a wall positioned adjacent the rear edge of the worksurface, both such constructions being conventional and well known.

The support rail arrangement 11 is intended for use in close association with the worksurface so as to provide additional mounting capability for office accessories or tools, such as the slotted divider arrangement 10. The support rail arrangement 11 includes an elongate support rail 21 which is preferably disposed so as to be adjacent and extend lengthwise along an edge of the worksurface 12, such as the rear edge 17 thereof. The support rail 21 is, in the illustrated arrangement, secured to an upper end of at least one, and typically a pair of, support arms or stanchions 22 which in the illustrated embodiment are secured to the worksurface and project upwardly therefrom adjacent the rear edge 17 so as to support the elongate support rail 21 in raised relationship relative to the worksurface.

The slotted divider arrangement 10 includes a generally horizontal support base or tray 26 which can be removably but stably supported on top of the support rail 21, with the tray 26 and rail 21 being attached in a manner described hereinafter. The support tray 26 in turn removably mounts thereon one or more slotted divider elements 27 which can be positioned on top of the base tray 26 in side-by-side relation so as to define a plurality of adjacent upwardly-opening storage slots which also open forwardly of the worksurface.

The support rail arrangement 11 will now be described in greater detail. Considering first the elongate support rail 21, this rail is of a generally shallow and inverted V-shape configuration in cross section, and includes a rear leg 31 which is generally horizontal in the front-to-back direction of the worksurface. This rear leg 31 in turn is joined to a front leg 32 which, as it projects forwardly from its junction with the rear leg, is angled downwardly so that the legs 31 and 32 define a shallow V-like configuration.

The rear leg 31 is defined by generally parallel and horizontal top and bottom walls 33 and 34, respectively, the latter being joined by a curved edge wall 35 at the rearward edges thereof. The walls 33 and 34 are vertically spaced so as to define a narrow slot 36 therebetween. This slot 36 extends lengthwise throughout the horizontal length of the rail and in addition opens horizontally forwardly so as to terminate at a mouth 37. The top wall 33, on the bottom surface thereof, is provided with a small downwardly projecting rib 38 which is disposed closely adjacent the closed end of the slot 36 for a purpose to be explained hereinafter.

The front leg 32 of the support rail is of similar construction in that it is defined by spaced but substantially parallel top and bottom walls 41 and 42, respectfully, which are joined at their front edges by a curved edge wall 43. These walls thus define a slot 44 therebetween which also extends lengthwise throughout the rail, and opens generally rearwardly through the mouth 37. The slot 44 preferably extends at an angle relative to both the horizontal and vertical, whereas the slot 36 extends preferably horizontally. The top wall 41, on the inner surface thereof, is also preferably provided with a lengthwise-extending small rib 45 projecting downwardly therefrom in the vicinity of the closed end of the slot 44.

The support rail 21 also has rib 46 extending lengthwise thereof along the undersurface of the rail substantially at the apex of the V as defined by the bottom walls 34 and 42. This rib 46 is of narrow width and projects outwardly only a limited extent, and at its outer end is joined to a lengthwise extending mounting rod 47 which is of increased cross-sectional size, and extends throughout substantially the length of the rail. The mounting rod 47 in the preferred embodiment is cylindrical in cross-section.

The support rail 21, in the illustrated embodiment, is supported in upwardly spaced relation along the rear edge of the worksurface by at least one, and quite typically two or more, support arms or stanchions 22. This support arm 22 includes a main body or tower part 51 which is supported on the upper surface of the worksurface 11 adjacent the rear edge 17 thereof, and is cantilevered upwardly. This main body part 51 at its upper end terminates in front and rear support surfaces 52 and 53, respectively, which are angled with respect to one another so as to substantially supportingly bear directly under the rail bottom walls 42 and 34, respectively. The body part 51 also has a sleeve part 54 affixed thereto and extending transversely in generally horizontal and parallel relationship with the lengthwise extent of support rail 21. This sleeve part 54 has a cylindrical opening 55 extending horizontally and transversely through the body part 51 adjacent the upper end thereof. A narrow slot 56 opens upwardly from the opening 55 between the support surfaces 52 and 53, and extends transversely across the upper end of the body part 51. The opening 55 and slot 56 enable the mounting rod 47 and rib 46, respectively, as associated with the support rail 21 to be slidably inserted therein so as to secure the rail 21 and body part 51 together.

To secure the body part 51 to the worksurface 12, the support arm 22 includes an L-shaped mounting part which has a generally upwardly extending leg 58 which overlaps and is fixedly secured to the rear upright surface of the body part 51. This, in the illustrated embodiment, is accomplished by means of a pair of pins 57 which project from the rear of the body part 51 and which are engaged within slots (not shown) formed in the upright leg 58 so as to permit fixed coupling of the leg 58 to the body part 51. This upright leg 58 is positioned so as to extend downwardly directly adjacent the worksurface rear edge 17 without protruding outwardly a significant extent, and the upright leg 58 at its lower end terminates in and is rigidly joined to a horizontally projecting forward leg 59, the latter being spaced downwardly from the bottom of the worksurface 12. This bottom horizontal leg 59 mounts thereon a manually adjustable fastening member 61. The latter is preferably threadedly engaged with the horizontal leg 59 and at its lower end has an enlarged head or knob which can be manually gripped, or gripped by a tool, so as to enable the upper end of the fastening member 61 to move into clamping engagement with the bottom of the worksurface upon rotation of the fastening member so as to secure the body part 51 tightly against the upper surface of the worksurface.

The overall construction of the support rail arrangement 11, as summarized above, is described in detail in copending application Ser. No. 09/304,162, filed concurrently herewith, entitled "Support Rail Assembly for Office Accessories", the disclosure of which in its entirety is incorporated herein by reference.

Considering now the slotted divider arrangement 10, and specifically the support tray 26, the latter is defined primarily by an enlarged, planar, plate-like or plate-shaped base wall 71 which extends in a generally horizontal plane when mounted on the support rail 21. The base wall 71 has a front edge 72 which is provided with a downwardly rounded or arcuate configuration both to improve the appearance thereof and to provide additional strength and stiffness. The rear edge of the base wall 71 has a flange 73 fixed thereto and projecting vertically upwardly therefrom through a small vertical extent, which flange also provides the base wall with increased strength and rigidity. This latter flange 73 also projects upwardly through a sufficient vertical extent so as to function as a rear stop or position limiting surface with respect to documents which are inserted into the slotted divider elements, as explained hereinafter.

Figure 2:
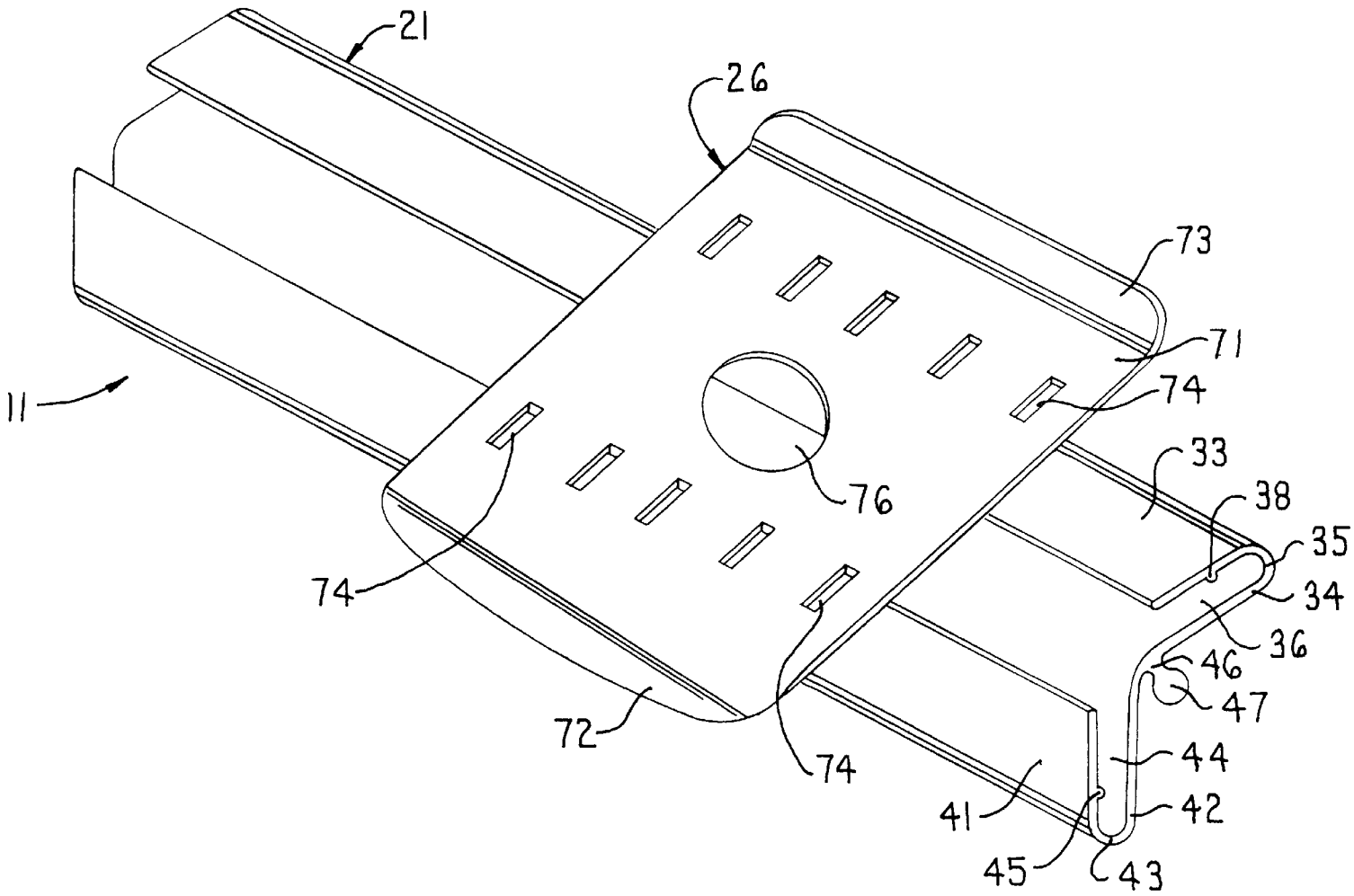
FIG. 2 is a perspective view similar to FIG. 1 except that the divider elements have been removed so as to illustrate solely the base tray mounted on the support rail.

As illustrated in FIG. 2, the base wall 71 has a plurality of small slots or openings 74 extending vertically therethrough. The slots 74 are disposed in uniformly spaced relationship within two rows which extend transversely across the width of the base wall, with one row being positioned more closely adjacent the front edge of the base wall, and the other row being positioned more closely adjacent the rear edge of the base wall. The rows of slots 74 are also spaced apart (i.e., in the front-to-back direction) by a distance which is greater than the front-to-back width of the support rail 21 so that the rows of slots are respectively positioned forwardly and rearwardly of the support rail.

To releasably but stably secure the support tray 26 to the support rail 21, the tray 26 has a mounting flange 75 associated with the base wall 71 substantially centrally thereof. This flange 75 is offset horizontally downwardly from the base wall 71 by a small distance, and the flange 75 at one end (the forward end) is joined to the base wall 71 by a thickened reinforcing portion 76 which extends vertically therebetween. The other or rearward end of the flange 75, as well as the side edges of the flange, are free of direct connection to the base wall 71, whereby the mounting flange 75 is cantilevered rearwardly from the reinforcing portion 76 and thus functions similar to a stiff but resilient plate spring. The flange 75, adjacent the free end thereof, is provided with a pair of detent ribs or a detent recess on the upper surface so as to create a releasable detent-type engagement with the rail rib 38 when the support tray 26 is mounted on the support rail 21.

With the construction of the base tray 26, the mounting flange 75 can be horizontally slidably inserted into the slot 36 associated with the rear rail leg 31 so that the base wall 71 of the tray 26 is securely and stably seated on the upper surface of the rail top wall 33 with this latter wall 33 being securely held between the base wall 71 and the mounting flange 75. The base tray is properly positioned and seated upon the support rail when the mounting flange 75 is fully inserted into the slot 36 so that the front edge of the top wall 33 substantially abuts the thickened portion 76 and at the same time the flange detents against the rail rib 38 so as to prevent accidental forward separation of the base tray from the support rail.

Considering now the construction of the slotted divider element 27, the latter when viewed in cross-section is of a generally upwardly-opening U-shape configuration and includes a main upright rear or support wall 81 which at its lower end is rigidly joined at a corner 91 to the rear of a base or bottom wall 82. This bottom wall 82 projects forwardly in substantially perpendicular relationship from the back wall 81 through a relatively small distance, and at its forward edge is joined through a corner 92 to a downwardly projecting front flange 83. The latter projects substantially perpendicularly downwardly from the bottom wall 82 so as to extend substantially in parallel relationship to the back wall 81. This front flange 83 is of short vertical extent and terminates in a lower free edge 84 which is adapted to bearingly engage the upper surface of the base tray 26 when the slotted divider element 27 is mounted thereon.

The slotted divider element 27 also has a front wall 86 which projects upwardly from the corner 92 substantially coplanar with the front flange 83. This front wall 86 extends upwardly in sidewardly spaced but substantially parallel relationship with the back wall 81 and thus, in cooperation with the bottom wall 82, defines a channel-like storage slot 89 which opens upwardly and outwardly at both ends.

The front wall 86 has a height which, as determined by the upper edge 87, is significantly less than, and in fact is typically about one-half the height of the back wall 81, the height of which is determined by its upper edge 87. The front wall 86 in the illustrated embodiment also has a generally rounded or arcuate peripheral edge so that it resembles approximately one-half of a cylinder or ellipse, and has a width (i.e., the length of the front wall in a direction transverse to the rail) which is significantly smaller than the width of the respective back wall 81, thereby providing improved aesthetics and accessibility with respect to at least the frontmost slotted divider element 27.

To assist in stable attachment of the divider elements 27 to the support tray 26, the front flange 83 of the divider element has a pair of sidewardly-spaced tabs or hooks 85 cantilevered downwardly from the free edge 84, which tabs or hooks project downwardly through a transversely spaced pair of slots 74 formed in the base tray 26. The hooks 85 are preferably J- or L-shaped so that the lower horizontally projecting legs thereof project transversely under the base wall 71 to provide stability to the slotted divider elements by resisting tipping thereof.

The slotted divider elements 27 can be individually positioned on the base tray 26 by orienting the divider elements so that the front and rear walls extend generally vertically to facilitate insertion of the J-hooks 85 through the slots 74 until the free edge of front flange 83 abuts the base wall 71. The slotted divider element is then vertically rotated through a small angle until the corner 91 abuts the top surface of the base wall 71, which in turn causes the J-hooks to engage under the base wall 71. A plurality of divider elements 27, up to four in the illustrated embodiment, can be sequentially mounted in side-by-side relationship on the base plate 26, which mounting starts from the rear and progressively works to the front. Further, due to the symmetry of the divider elements, they can be horizontally rotated 180° for mounting on the base plate so as to be inclined either rightwardly or leftwardly depending upon the preferred orientation of the worker.

Figure 5:
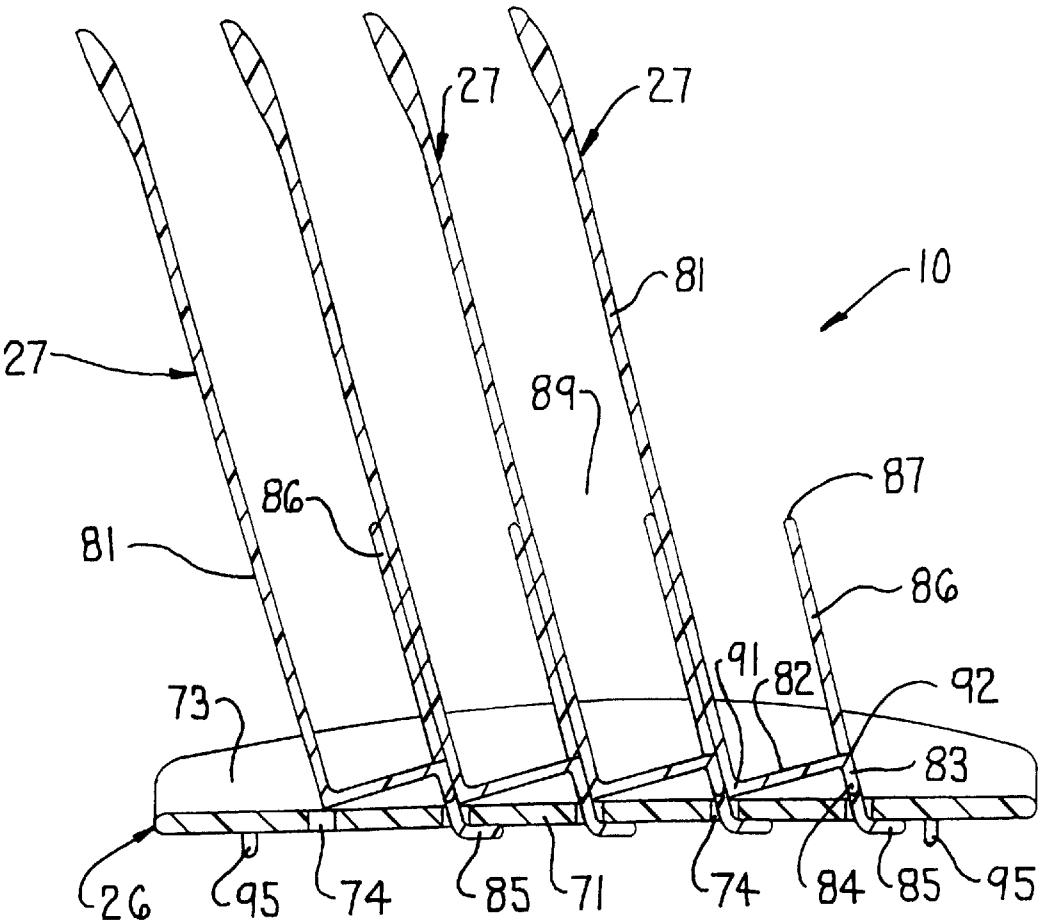
FIG. 5 is a longitudinal elevational sectional view illustrating the construction of the divider elements and the mounting thereof on the base tray.

The slots 74 associated with the base plate are preferably spaced apart by a distance which substantially corresponds to the width of the divider elements when the latter are mounted on the base tray, whereby a plurality of divider slots 89 can thus be positioned in closely adjacent side-by-side relationship, substantially as illustrated by FIG. 5.

With the divider elements 27 mounted on the base tray 26, substantially as illustrated by FIG. 5, the plurality of storage slots 89 are readily accessible either from above or from the front of the worksurface, and thus various documents or objects can be conveniently stored within the storage slots 89. The rear flange 73 of the base plate 26 preferably projects upwardly a sufficient extent so as to project above the upper surfaces of the inclined bottom walls 82 of the divider elements 27, and thus functions as a stop surface for documents inserted into the storage slots.

When the slotted divider elements 27 are mounted on the horizontally oriented base tray 26, the front and back walls 81, 86 of the divider elements are disposed so as to extend at a small angle or incline relative to the vertical, and likewise the bottom wall 82 of the divider element also extends at a small incline relative to the horizontal, whereupon documents disposed in a respective storage slot will naturally lean against and be supported by the respective back wall 81.

The slotted divider element 27 in its entirety, and the base tray 26 in its entirety, are each preferably formed from a generally thin sheet-like material so as to have a substantially uniform thickness throughout. In a preferred embodiment both the slotted divider element 27 and the base tray 26 are each formed in one piece of a plastics material, such as ABS, PP, or HDPE, such as by injection molding. While the latter is preferred, it will be recognized that other forming and manufacturing techniques and materials can be utilized.

The support rail 21 is preferably constructed of metal, such as aluminum, but other suitable materials can be utilized.

While the construction and assembly of the slotted divider arrangement on the support rail has been described above, it will be appreciated that the slotted divider arrangement can also be readily removed from the support rail, either partially or totally. For example, the slotted divider elements 27 can be removed from the base tray 26 so that the latter remains on the support rail 21 and functions as a horizontal supporting tray or surface, as illustrated in FIG. 2, or if desired the base tray 26 can also be readily removed from the support rail. Further, the base tray 26 when mounted on the support rail 21, either with or without the slotted divider elements thereon, can also be slidably displaced longitudinally along the support rail so as to permit desired positioning thereof relative to the worksurface.

The base tray 26 also includes pairs of feet 95 projecting downwardly from base wall 71 through a greater distance than the flange 75. These feet 95 enable the divider arrangement to be directly stably supported on the worksurface.

While the support rail arrangement has been described above in conjunction with support stanchions which are secured to and project upwardly from the worksurface, it will be appreciated that the support rail can be supported independently of the worksurface, such as by means of arms which secure to an adjacent wall and project outwardly therefrom for securement to the support rail in the same manner as described herein, in which case the rail and its support would thus be free of any direct support or connection to the worksurface. This latter arrangement is described in copending Ser. No. 09/304,162 identified above, so that further description thereof is believed unnecessary.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A workstation comprising:

a worksurface having longitudinally extending front and rear edges and defining thereon a substantially horizontally enlarged upper surface;

a horizontally elongated support rail stationarily positioned adjacent the rear edge of the worksurface but spaced a substantial distance upwardly above said upper surface, said support rail having a part which is of a channel-shaped cross section so as to define a narrow groove which is elongated along the support rail and opens outwardly through a peripheral edge thereof, a top portion of said groove being closed by a top wall of said support rail; and a slotted divider arrangement for organizing documents and supported in its entirety on said support rail so as to be free of direct supportive engagement with the worksurface, said slotted divider arrangement including a base part which is supportingly engaged on top of and adjacent said top wall of said support rail and which has a cantilevered connecting part that projects into said groove to releasably secure said base part to said support rail, and a plurality of divider elements supported on and projecting upwardly from said base part, said divider elements each including a generally enlarged and substantially planar upright wall, whereby the upright walls of adjacent divider elements cooperate to define therebetween a plurality of channel-shaped storage slots which accommodate storage of documents therein.

2. A workstation according to claim 1, wherein each said divider element is defined by a generally one-piece upwardly-opening channel member which includes generally parallel and transversely-spaced front and rear walls rigidly joined together by a bottom wall extending transversely between lower edges thereof, said rear wall defining said enlarged upright wall, a plurality of said one-piece channel members being supported on said base part in sidewardly adjacent relationship so as to define a plurality of adjacent storage slots.

3. A workstation according to claim 2, wherein said base part comprises a one-piece plate-shaped member having a generally horizontally enlarged plate-shaped base wall which is supportingly engaged on top of said support rail, and said channel members being releasably supportingly engaged on top of said plate-shaped base wall so as to project upwardly therefrom.

4. A workstation according to claim 3, wherein said bottom wall projects generally perpendicularly between said front and rear walls, and wherein a vertically short support flange is joined to and projects vertically downwardly from said bottom wall in the vicinity of said front wall for supportive engagement with an upper surface of said base wall, whereby the channel members assume an angled relationship relative to the base wall so that the bottom wall extends at an angle relative to the horizontal and the front and rear walls extend at an angle relative to the vertical.

5. A workstation according to claim 1, wherein said top wall of said support rail has a flat horizontal top surface.

6. A workstation according to claim 1, wherein said groove extends in a horizontal direction across a width of said support rail defined transversely relative to the elongated direction thereof.

7. A workstation according to claim 1, including at least one support arm supported on the upper surface of the worksurface, the support arm supporting the elongated support rail at the substantial distance upwardly above the upper surface.

8. A divider arrangement for organizing documents comprising:

a horizontally enlarged base part for supportive engagement with a generally horizontal support surface; and a plurality of divider elements supported on and projecting upwardly from said base part, each said divider element being defined by a one-piece upwardly-opening channel member which includes generally parallel and transversely spaced-apart front and rear walls rigidly joined together by a bottom wall extending transversely between lower edges thereof, a plurality of said channel members being individually supported on said base part in sidewardly adjacent relationship so as to define a plurality of adjacent storage slots, each said channel member being positioned in an angled relationship relative to said base part so that said bottom wall projects upwardly at an angle relative to the horizontal from said lower edge of said rear wall to said lower edge of said front wall and said front and rear walls extend at an angle relative to the vertical, said front wall of each said channel member at the lower edge thereof including a downwardly projecting hook structure which engages within a slot formed in said base part to releasably secure the respective channel member to said base part.

9. A workstation comprising:

a worksurface having longitudinally extending front and rear edges and defining thereon a substantially horizontally enlarged upper surface;

a horizontally elongated support rail stationarily positioned adjacent the rear edge of the worksurface but spaced a substantial distance upwardly above said upper surface, said support rail having a part which is of a channel-shaped cross section so as to define a narrow groove which is elongated along the support rail and opens outwardly through a peripheral edge thereof; and a slotted divider arrangement for organizing documents and supported in its entirety on said support rail so as to be free of direct supportive engagement with the worksurface, said slotted divider arrangement including a base part comprising a one-piece plate-shaped member having a generally horizontally enlarged plate-shaped base wall which is supportingly engaged on top of said support rail and which has a cantilevered connecting part which projects into said groove to releasably secure said base part to said support rail, and a plurality of divider elements supported on and projecting upwardly from said base part, said divider elements each being defined by a generally one-piece upwardly-opening channel member which includes generally parallel and transversely-spaced front and rear walls rigidly joined together by a bottom wall extending transversely between lower edges thereof, said rear wall defining an enlarged and substantially upright planar wall, a plurality of said one-piece channel members being releasably supportingly engaged on top of said plate-shaped base wall in sidewardly adjacent relationship so as to project upwardly therefrom and define a plurality of adjacent storage slots which accommodate storage of documents therein;

the front wall of each of the channel members adjacent a lower edge thereof being provided with a projecting hook structure which engages within a slot formed in the base wall to releasably secure each of the channel members to the base wall.

10. A workstation according to claim 9, wherein the base part comprises a stiff but resiliently deflectable flange which is secured to and offset downwardly from the base wall for projection into the groove of the support rail, said flange and said groove both being oriented substantially horizontally.

11. A workstation comprising:

a worksurface having longitudinally extending front and rear edges and defining thereon a substantially horizontally enlarged upper surface;

a horizontally elongated support rail stationarily positioned adjacent the rear edge of the worksurface but spaced a substantial distance upwardly above said upper surface, said support rail having a part which is of a channel-shaped cross section so as to define a narrow groove which is elongated along the support rail and opens outwardly through a peripheral edge thereof, a top portion of said groove being defined by a top wall of said support rail; and a slotted divider arrangement for organizing documents and supported in its entirety on said support rail so as to be free of direct supportive engagement with the worksurface, said slotted divider arrangement including a one-piece base member having a substantially thin plate-shape and a horizontally enlarged base wall which is supportingly engaged on top of and adjacent said top wall of said support rail and which has a cantilevered connecting part fixedly and integrally joined thereto that projects into said groove to releasably secure said base member to said support rail, and a plurality of divider elements removably supported on and projecting upwardly from said base member, said divider elements each including a generally enlarged and substantially planar upright wall, whereby the upright walls of adjacent divider elements cooperate to define therebetween a plurality of channel-shaped storage slots which accommodate storage of documents therein.

12. A workstation according to claim 11, wherein each divider element comprises a one-piece unitary element which are individually but removably mounted on the base part so that the number of elements mounted on the base part can be readily varied.

13. A workstation according to claim 12, wherein each said divider element has a generally upwardly-opening U-shaped cross section which defines a said storage slot therein and which mounts on said base part so that the storage slot opens transversely relative to the elongate direction of the support rail.

* * * * *